United States Patent [19]

Roderman

[11] Patent Number: 4,908,879

[45] Date of Patent: Mar. 20, 1990

[54] TANNING SPORTS GLOVE

[76] Inventor: Robert J. Roderman, 11227 Sageriver, Houston, Tex. 77089

[21] Appl. No.: 262,697

[22] Filed: Oct. 26, 1988

[51] Int. Cl.[4] ..... A41D 19/00

[52] U.S. Cl. ..... 2/161 A; 2/159; 2/167; 2/243 A

[58] Field of Search ..... 2/159, 161 A, 160, 167, 2/163, 243 A

[56] References Cited

U.S. PATENT DOCUMENTS

| | | | |
|---|---|---|---|
| 2,314,545 | 3/1943 | Lindfelt | 2/159 |
| 2,327,836 | 8/1943 | Willard | 2/159 |
| 2,710,409 | 6/1955 | Burandt | 2/160 |
| 3,274,616 | 9/1966 | Russo | 2/161 A |
| 3,588,917 | 6/1971 | Antonious | 2/161 A |
| 3,600,715 | 8/1971 | Perrella | 2/161 A X |
| 3,649,967 | 3/1972 | Millman | 2/161 A |
| 3,847,110 | 11/1974 | Inoue | 2/161 A X |
| 4,489,444 | 12/1984 | Graham | 2/160 |
| 4,525,877 | 7/1985 | Chong | 2/161 A |
| 4,785,478 | 11/1988 | Mosley | 2/161 A X |

FOREIGN PATENT DOCUMENTS

| | | | |
|---|---|---|---|
| 1435897 | 2/1969 | Fed. Rep. of Germany | 2/115 |
| 2540355 | 8/1984 | France | 2/243 A |

*Primary Examiner*—Werner H. Schroeder
*Assistant Examiner*—Sara M. Current
*Attorney, Agent, or Firm*—Richard C. Litman

[57] ABSTRACT

An improved sports glove for use in a game such as golf includes a portion for covering the back of the hand and a palm-covering portion. The back of the hand-covering portion is made of a material transparent to ultraviolet light rays, such as Microsol whereby in use the wearer obtains a tanning of the back of the hand. The glove also contains fastening means which can also serve as a holder for golf ball markers.

2 Claims, 1 Drawing Sheet

TANNING SPORTS GLOVE

BACKGROUND OF THE INVENTION

The present invention relates to a sports apparatus and more particularly to a sports glove. While the glove of this invention has been found to be useful in numerous sports activities such as tennis, baseball, boating and many others, it has found special merit with respect to a glove for use in the game of golf. Golf gloves are worn by golfers primarily on the lowermost hand which grasps the top portion of the shaft of a golf club for the purpose of improving the grip, avoiding blisters and the effects of perspiration, and whereby the enhanced grip allows the player to hit a better shot. Obviously, the improved grip aids in precluding the club from slipping or flying out of the golfer's hand.

The typical prior art glove has been manufactured from relatively thin layers of natural or synthetic leather-like materials. Normally, such gloves have been made in a variety of sizes which are adapted to fit the individual hand size of the user. In instances where a high degree of abrasion was expected during use, some prior art gloves have been reinforced by the addition of layers of fabric on the interior surfaces.

A decided shortcoming of known sports gloves is that a definite tan-line remains on the user's body following sustained exposure in the sun. This line will appear across that area on the back of the wearer's wrist and is formed by the rear edge of the back side of the glove. Since golfers pursue their sport in a totally unsheltered environment and during extended periods of time, usually always including the hours the sun is at its highest elevation, it follows that the exposed arms and backs of their wrists will become quite sun tanned, thereby resulting in totally un-tanned backs of their hands after leaving the course with their gloves removed.

Many golf gloves are constructed with perforated backs to encourage cooling and this feature alone, of course exacerbates the situation by not only forming the tan-line but also, round suntan sports as created by the glove perforations.

Regardless of construction, all of the sport gloves heretofore available have been unsatisfactory in one or more respects. Typically, such gloves have been difficult to put on and remove and have become permanently distorted in the process of repeated wearings, causing abrasion and otherwise defeating the purpose of the glove.

DESCRIPTION OF THE RELATED ART

Exemplary of prior art gloves are those shown in U.S. Pat. Nos. 3,600,715, 3,588,917, 3,274,616, and 4,525,877.

U.S. Pat No. 3,600,715 to Perrella discloses a golf glove which remains smooth and taunt on the hand of a golfer through prolonged use and repeated donning and removal.

U.S. Pat No. 3,588,917 to Antonious discloses a golf glove having a Velcro closure and a slit in the palm of the glove to facilitate removal.

U.S. Pat No. 3,274,616 issued to Russo discloses a golf glove having a Velcro closure which serves to hold the glove in place and reinforce the wrist.

U.S. Pat No. 4,525,877 issued to Chong discloses a sports glove having a frontal portion manufactured of leather, a rear portion manufactured of terry cloth, a slit in the cuff and a Velcro closure across the wrist.

While these patents disclose various sport gloves none of them, taken singly or in any combination, disclose the specific details of the glove of this invention.

SUMMARY OF THE INVENTION

By the present invention, an improved novel sports glove is provided with more satisfactorily addresses the aforementioned problems of the prior art and which is significantly improved in other respects. More specifically, the present invention combines a plurality of unique features, the combination of which greatly enhances the use of sports gloves as compared with the prior art.

In general, the present invention comprises a "tan-thru" sports glove through which ultraviolet light rays may pass to cause the skin of the gloved hand to become pigmented or, as is commonly known, tanned. The glove is adapted to extend over the hand of a human being, including finger covering portions, a thumb covering portion, a palm covering portion, a wrist covering portion and a portion for covering the back of the hand wherein all of the portions are interconnected together. The top half or portion of the glove covering the back of the hand and fingers is constructed of a material such as a 100% mercerized cotton-like fabric, which is substantially transparent to light rays from the ultraviolet spectrum whereby an even tanning of the hands is obtained. The bottom half or palm covering portion may be constructed of a material such as cabretta leather which is tanned to make it water-resistant, or other flexible fabric material. The sport glove has a slit on the side adjacent the edge of the hand which allows the glove to be put on and removed easily. Fastening means, such as a VELCRO closure, spans the side slit to facilitate removal and effect a snug fit when worn.

It is therefore an object of the present invention to provide a sports glove, the construction of which allows the user to obtain an even tanning of the back of both hands and thus discourage the usual tan line formed between the back of one's wrist and hand.

It is an additional object of the invention to provide an improved sports glove which significantly increases the ease and convenience of placing the glove on the user's hand and removing it repeatedly. It is still another object of the present invention to provide a glove, particularly for use in the game of golf, the construction of which provides storage means for ball marker devices.

With these and other objects in view which will more readily appear as the nature of the invention is better understood, the invention consists in the novel construction, combination and assembly hereinafter more fully illustrated, described and claimed, with reference being made to the accompanying drawings.

BRIEF DESCRIPTION OF THE DRAWING

Similar reference characters designate corresponding parts throughout the several figures of the drawing.

DESCRIPTION OF THE PREFERRED EMBODIMENT

Figure 1:
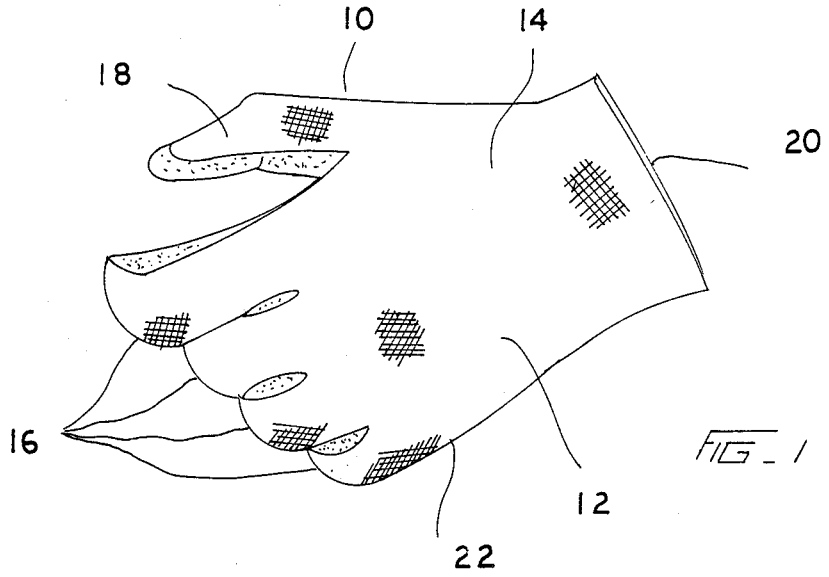
FIG. 1 is a perspective view of a left-handed glove of the present invention, illustrating the back side of the glove.

Referring now to the drawing, FIG. 1 shows a sport glove 10 having a back panel 12 including integral hand, finger and thumb covering portions 14,16, and 18, respectively. This back panel 12 is sized to fully overlie the rear surfaces of the respective hand areas associated with the panel portions and is made of any material transparent to ultraviolet light rays whereby the hand of the user is tanned with the glove in place. A particularly useful material is "Microsol", a 100% mercerized cotton-like fabric.

As shown in the drawing, the back panel 12 extends from the glove rear edge 20 to completely mask those portions of a wearer's hand which normally are exposed to the majority of the sun's rays while one is engaged in a sport such a golf. Thus, the glove rear edge 20 will be understood to extend rearwardly to a point adjacent the user's wrist. A preferably continuous edge seam or periphery 22 of the back panel 12 defines the lateral boundary of the hand area covers thereby.

Figure 2:
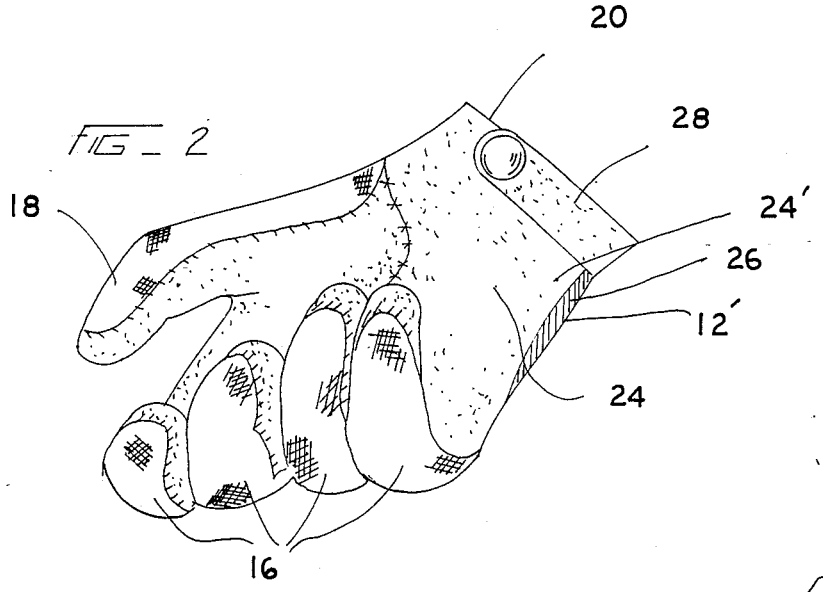
FIG. 2 is a perspective view of the palm side of a righthanded glove.
Figure 3:
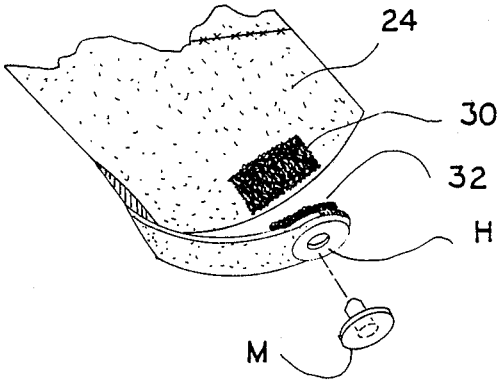
FIG. 3 is a fragmentary view of the wrist portion of the glove of FIG. 2.

FIG. 2 shows the opposite, face or palm side of the present glove and will be seen to comprise an inner panel 24 which may be constructed of leather or other strong flexible fabric as noted above. This fabric desirably extends over the tips of the fingernails to prevent damage to the glove. At least a significant portion of the sides of the fingers and thumb are also covered with this fabric as depicted in FIGS. 1 and 2. Along the side of the glove, aligned with the seam 22 adjacent the small finger, is a slit 26, shown in FIG. 2 and which forms flap portions 12' and 24'. This construction allows the user to easily put on and remove the glove. To maintain a proper fit when the glove is worn, a strap 28 extends from one of the flap portions, preferably the back flap portion 12', and overlies the other flap portion wherein it is removably affixed by suitable fastener means such as mating VELCRO patches 30,32.

While the glove is useful in various sports or activities, it is particularly useful in the game of golf. In this game, a player's ball on a green will often lie along the path between the cup and the ball of another player. To overcome possible interference, the position of the interfering ball is marked with a metal ball-marker M in the form of a disc-shaped base from which a short spike projects which is pressed into the green. The ball marker M is provided with a convenient holder H including a bore into which the short spike of the marker may be snap-fitted. In use, the wearer may easily unsnap the ball marker M and remove for placement on the green.

As a result of the improved construction set forth herein, those having skill in the art to which the present invention pertains may perceive various modifications and additions which may be made thereto. By way of example, the apparatus may be constructed of numerous materials and in various colors. Accordingly all such modifications and additions are deemed to be within the scope of the invention, which is to be limited only by the claims appended hereto.

I claim:

1. A sports apparatus comprising:

a glove adapted to extend over the hand of a human being, said glove including;

an inner panel adapted to substantially overlie the palm and inner surfaces of a wearer's thumb and fingers, a back panel having portions covering the back of the fingers, thumb and and hand, said back panel being constructed of from a MICROSOL mercerized cotton-like material, and all of said back panel portions being interconnected and substantially transparent to ultraviolet rays due to said MICROSOL mercerized cotton-like material, whereby in use a tanning of the hand is obtained, said glove further comprising;

a rear edge adapted to engage a wearer adjacent their wrist, said inner and back panels separated along a line overlying the edge of a wearer's hand adjacent said rear glove edge to provide two flaps, a strap on one said flap adapted to overlie the other said flap, and mating fastening means on said strap and said other said flap, holding means for a ball marker comprising a receptacle disposed on said strap for accepting a spike end of a ball marker, said receptacle holding said ball marker in a friction snap fit.

2. The glove of claim 1 wherein:

said inner panel is constructed of a flexible fabric of leather-like material.

* * * * *